US005350113A

United States Patent [19]

Coogan

[11] Patent Number: 5,350,113

[45] Date of Patent: Sep. 27, 1994

[54] AIR FLOW CONTROL SYSTEM AND METHOD FOR A DUAL DUCT SYSTEM

[75] Inventor: James J. Coogan, Des Plaines, Ill.

[73] Assignee: Landis & Gyr Powers, Inc., Buffalo Grove, Ill.

[21] Appl. No.: 97,397

[22] Filed: Jul. 23, 1993

[51] Int. Cl.[5] ..... F24F 13/04

[52] U.S. Cl. ..... 236/13; 236/49.3

[58] Field of Search ..... 236/13, 49.3

[56] References Cited

U.S. PATENT DOCUMENTS

| | | | |
|---|---|---|---|
| 3,037,702 | 6/1962 | Mauer et al. | 236/13 |
| 3,622,070 | 11/1971 | Sawyer | 236/13 |
| 3,687,364 | 8/1972 | McNabney | 236/49.3 |
| 4,148,435 | 4/1979 | Meyers et al. | 236/13 |
| 4,270,694 | 6/1981 | Knauth | 236/49.3 |
| 4,294,403 | 10/1981 | Ammons et al. | 236/13 |
| 4,420,811 | 12/1983 | Tarnay et al. | 364/510 |
| 4,757,944 | 7/1988 | Kagohata et al. | 236/91 F |
| 4,917,174 | 4/1990 | Ring | 165/26 |
| 5,076,346 | 12/1991 | Otsuka | 165/22 |

OTHER PUBLICATIONS

1991 Ashrae Handbook, "Heating, Ventilating, and Air-Conditioning Applications," *American Society of Heating and Air-Conditioning Engineers, Inc.*, Atlanta, Georgia, pp. 41.25–41.27.

*Primary Examiner*—William E. Tapoical

*Attorney, Agent, or Firm*—Greer, Burns & Crain, Ltd.

[57] ABSTRACT

A dual-duct HVAC system for providing a desired comfort level in a room, includes a controller that carries out a simple operation that determines the total open damper positions for dual dampers in a dual duct system to effect a desired air flow. Using the total open damper position information as damper control information, the controller also determines a relative damper position difference required between the two dampers to effect a desired temperature level while also meeting the air flow requirement as determined from the total open damper position information. The combination of the total open damper position information and the relative damper position difference is used as control information to control both dampers. Preferably, the controller gives priority of air flow control over temperature control by determining a valid damper position difference range for use in conjunction with the total open damper position information.

8 Claims, 7 Drawing Sheets

AIR FLOW CONTROL SYSTEM AND METHOD FOR A DUAL DUCT SYSTEM

BACKGROUND OF THE INVENTION

The invention relates generally to HVAC (heating, ventilating and air conditioning) systems and more particularly to systems and methods for controlling temperature and/or air flow in a dual duct system.

The temperature and ventilation of an area within a building may be controlled through the use of a dual duct terminal box. The terminal box typically includes a hot air inlet duct, a cold air inlet duct, a mixing area where mixing of the hot and cold air occurs, and an outlet duct for passing the mixed air to the area. The temperature and ventilation for the room may be controlled by modulating the air flow rate of warm or cool air supplied to the mixing area. This is typically accomplished by the use of a damper or valves in each of the hot air inlet duct and the cold air inlet duct which are typically controlled by a control system. The dampers are used to regulate the rate of air flow exiting the mixing box and the air temperature exiting the mixing box. Each damper may be positioned in a separate air duct.

Several systems are known for controlling the dampers to obtain a desired comfort level within the room. One known system involves treating the HVAC system as two separate single-input single-output (SISO) systems wherein one control loop operates one damper, usually the cold air damper, to regulate the total air flow while another control loop operates the other damper, such as the hot air damper, to control the temperature in the room. However, a problem arises with such a system since increasing the air flow using the cold air damper will also reduce the temperature of the air. The control system for the temperature then determines that the air temperature is too low and, consequently, opens the hot air damper which increases the total flow and leads to the cold air damper closing again. As a result, the control performance of the system tends to be poor since the system does not hold temperature and flow set points very well.

Another problem arises when one damper reaches an end of its stroke (i.e., in a fully open or fully closed position). At such a point, the HVAC system loses control of the variable associated with the damper. For example, if the damper is the air flow control damper, the control loop for operating that damper reaches a maximum condition so that the damper position can not be changed to properly effectuate the necessary air flow requirement.

Another known approach for controlling dual duct systems is to mechanically link the hot and cold dampers to control air temperature and to add a separate flow control damper in the outlet duct to control air flow to the area. However, the added complexity of the mechanical linkage between the hot and cold dampers typically reduces system reliability by increasing the number of moving parts. Also, the additional flow control damper increases the cost and control complexity of the control system.

SUMMARY OF THE INVENTION

Accordingly, it is a general object of the present invention to provide an improved dual duct control system for overcoming the above problems.

It is also an object of the present invention to provide an improved method and system for controlling temperature and air flow when the dampers are not at their limits while providing absolute priority to flow control or temperature control when either of the dampers reaches its physical limits.

It is yet a further object of the present invention to provide an improved control method and system for a dual duct system which may provide suitable comfort levels through the use of a lower cost system.

Another object of the present invention is to provide such a control method and system for a dual duct system which electrically controls direct movement of a plurality of dampers in the same direction to control air flow and electrically controls direct movement of a plurality of dampers in the opposite direction to control temperature.

It is yet a further object of the invention to provide such a control method and system for a dual duct system which generates an electric control signal for both dampers in response to each of the air flow adjustment signal and the air temperature adjustment signal so that both dampers are moved to control temperature and both dampers are moved to control air flow.

An improved control system for a dual duct system includes a set point selector for selecting a desired temperature set point for the area and for selecting a desired air flow set point for the area. An outlet duct temperature sensor generates a feedback temperature signal indicative of a air temperature in the area or air temperature to the area. An outlet duct air flow sensor generates a feedback air flow signal indicative of an amount of air flow to the area or in the area.

The system includes a controller having a temperature control stage, an air flow control stage and a damper position control stage. The controller generates an air flow adjustment signal, such as a damper position sum signal, based upon the air flow set point and the air flow signal. The air flow adjustment signal represents a total amount of damper opening position required for the combination of both dampers to effectuate the desired air flow.

The controller also generates a temperature adjustment signal, such as a damper position difference signal, that corresponds to the total relative position difference required between the two dampers to effectuate the set point temperature. The temperature adjustment signal is based upon the temperature set point and the feedback temperature signal.

The controller generates electric damper position control signals to electrically control both dampers in response to each of the air flow adjustment signal and the air temperature adjustment signal by generating damper position control signals for both dampers. Hence the flow adjustment signal influences the movement of both dampers, and the temperature adjustment signal influences movement of both dampers. The controller detects when one of the dampers is at an end of its stroke and gives priority to one of the control parameters (air flow and temperature).

In a further embodiment, the controller prioritizes air flow control over temperature control by dynamically determining an acceptable damper position difference range, based on the air flow adjustment signal and a known position of each damper. The acceptable damper position difference range represents a range of relative damper position settings wherein the damper opening for both dampers achieves the air flow requirement and the position difference between the dampers does not cause either of the dampers to exceed their stroke. Generating this predetermined acceptable operating range improves the response characteristics of the control system by substantially preventing a reset wind-up condition. Accordingly, the controller generates damper position control signals for each damper that fall within the damper position difference range. Priority may alternatively be given to temperature control when one of the dampers has reached an end of its stroke.

A method for controlling air flow in a multiduct HVAC system includes generating an air flow adjustment signal based upon the air flow set point and the air flow signal. The air flow adjustment signal represents a total amount of damper opening position required for the combination of both dampers to effectuate the desired air flow. The method further includes generating a temperature adjustment signal based upon the temperature set point and the temperature signal. The temperature adjustment signal represents a difference in damper position between the dampers necessary to effect the temperature set point.

The method further includes the step of electrically controlling both dampers in response to each of the air flow adjustment signal and the air temperature adjustment signal in an effort to effect both the selected air flow set point and the selected temperature set point. The step of electrically controlling both dampers may include generating an electric damper position control signal for concurrently controlling both dampers.

To effect priority of one control parameter over the other, the method may further include determining whether either of the dampers is at an end of its stroke and then prioritizing air flow control over temperature control when at least one of the dampers has reached an end of its stroke. Consequently, the dampers are electrically controlled to effect the air flow set point at the expense of attaining the temperature set point. Where temperature control is selected as the priority parameter, the method may include the step of prioritizing temperature control over air flow control when at least one of the dampers has reached an end of its stroke.

DETAILED DESCRIPTION OF THE DRAWINGS

Figure 1:
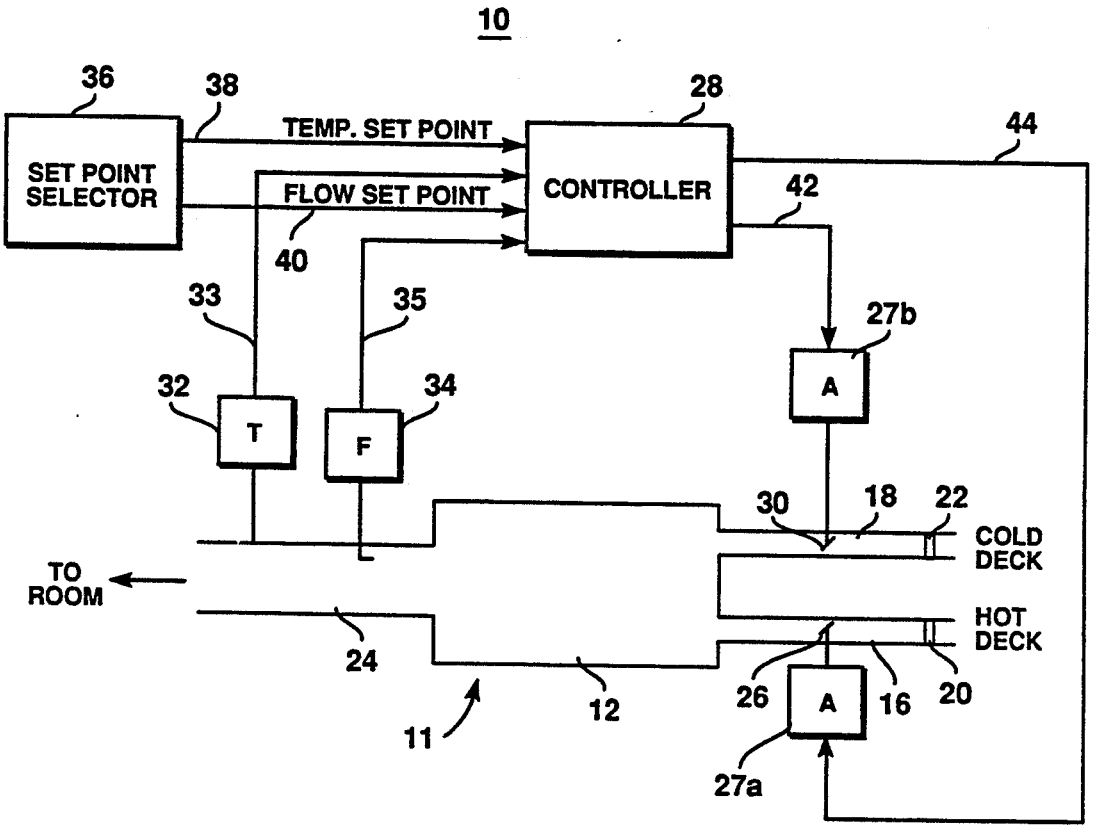
Figure 2A:
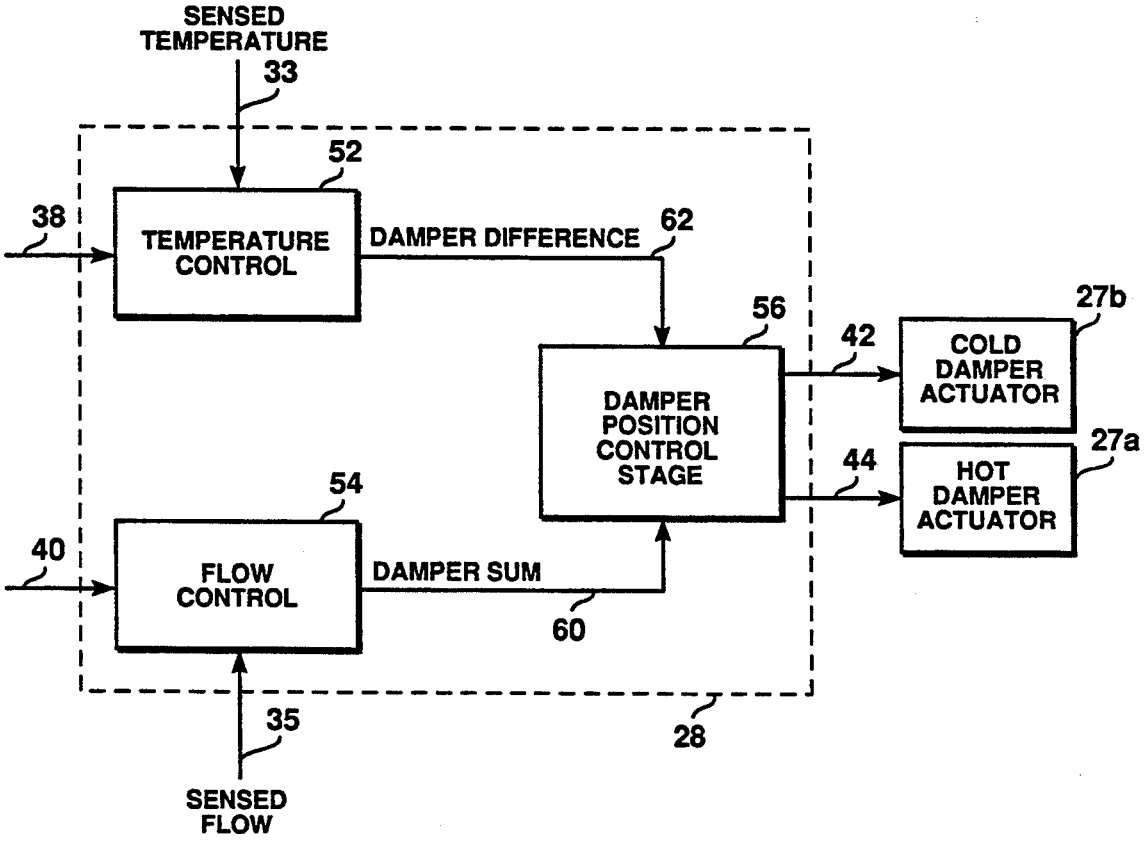
Figure 2B:
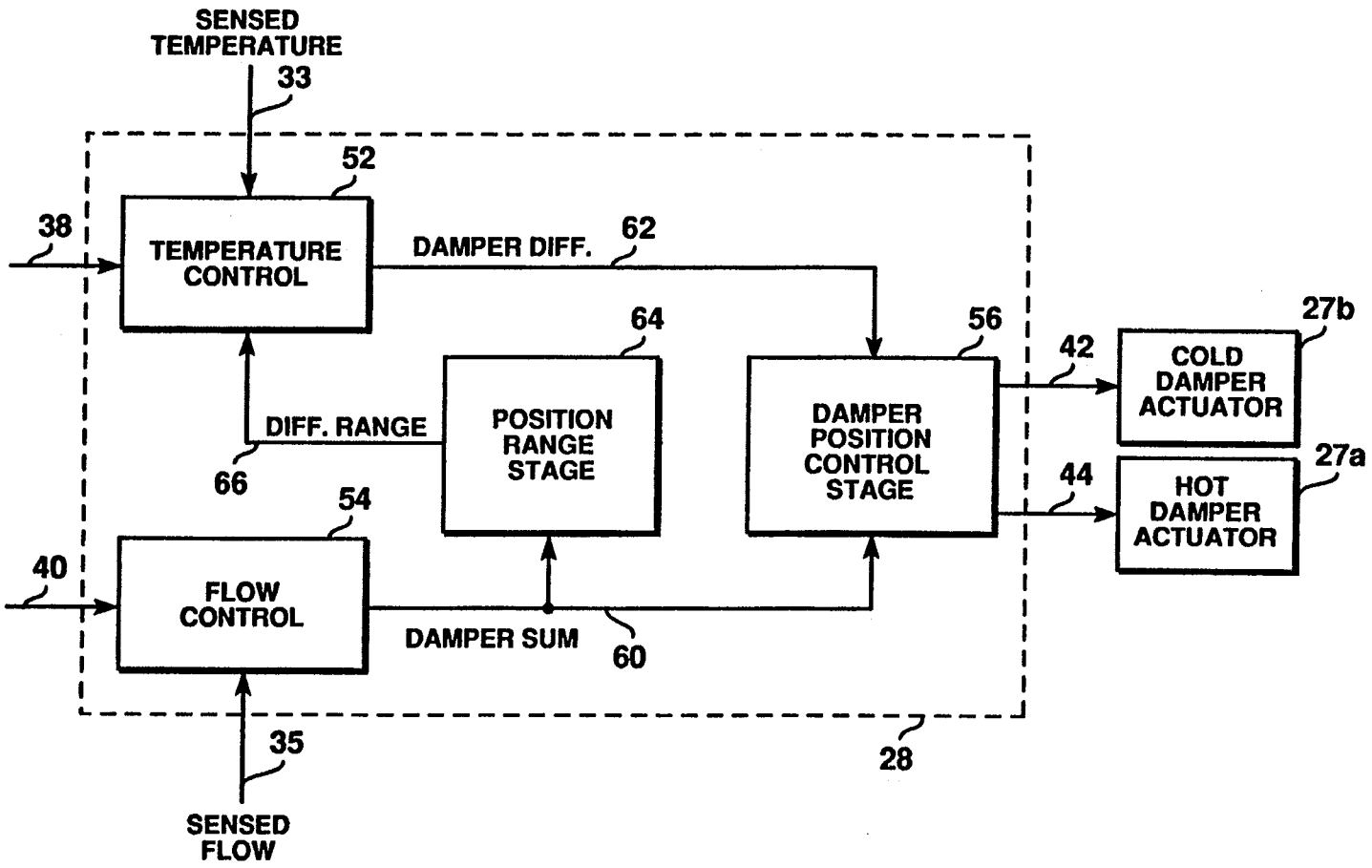
Figure 2C:
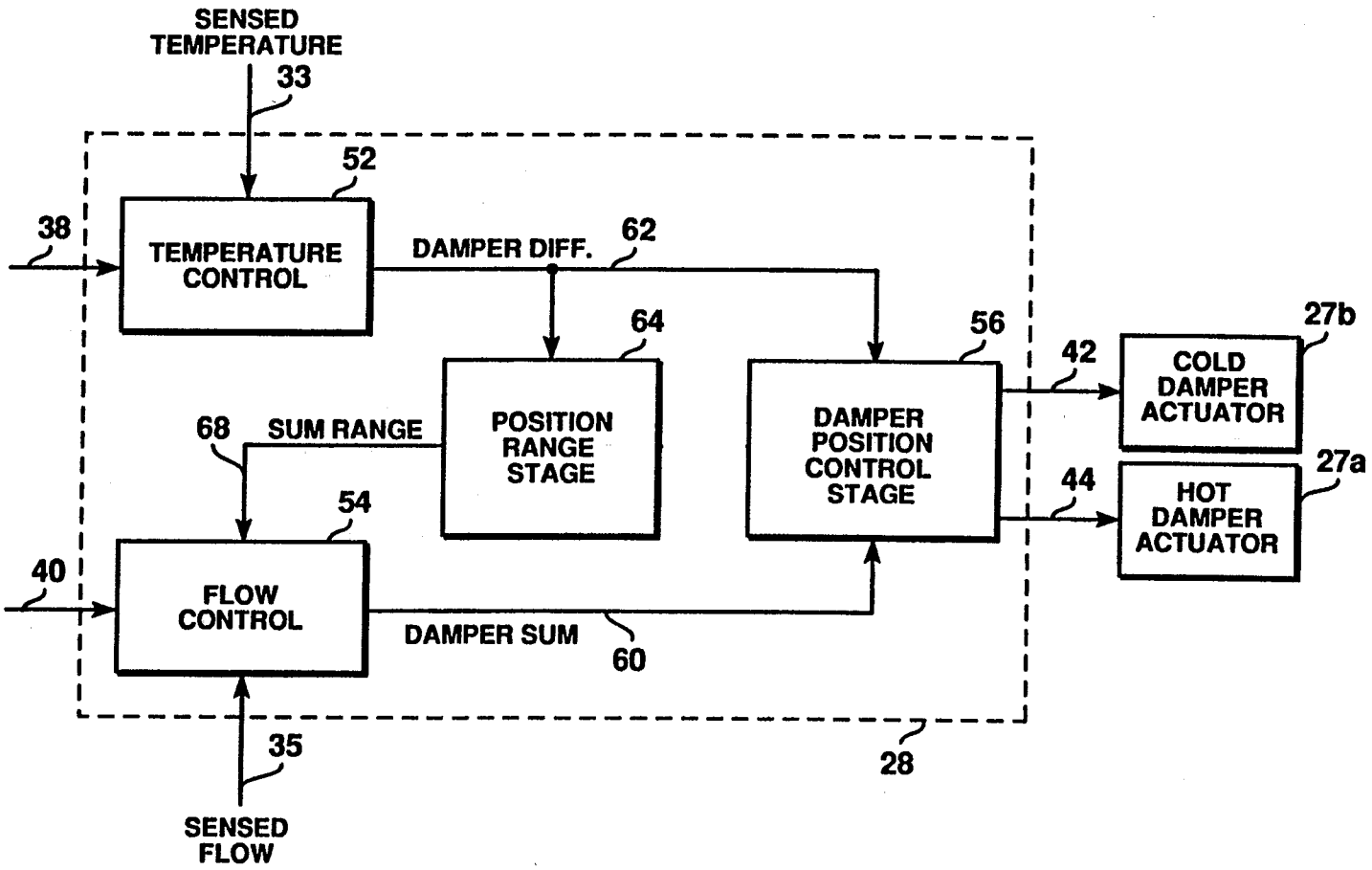
Figure 3:
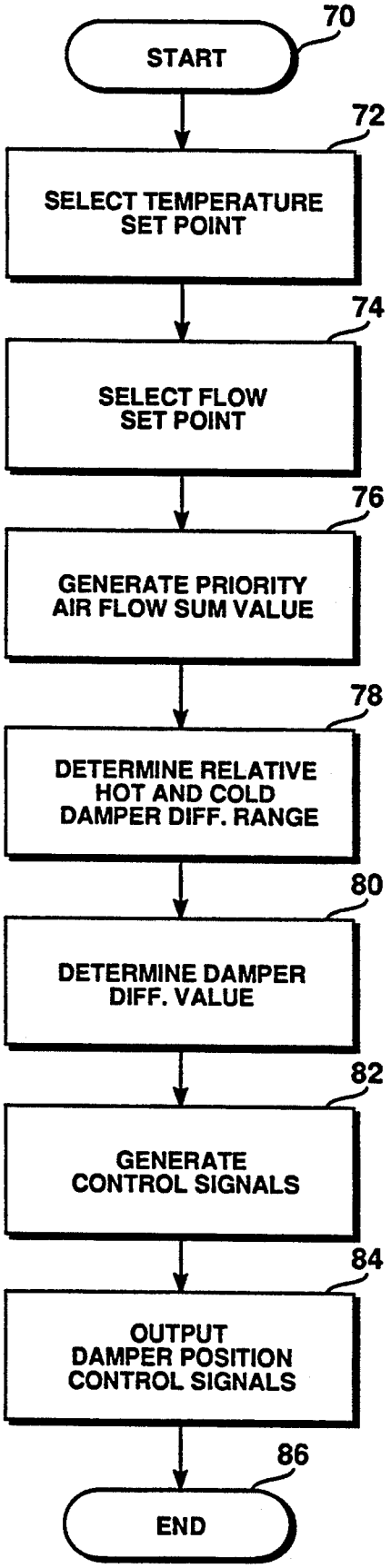
Figure 4A:
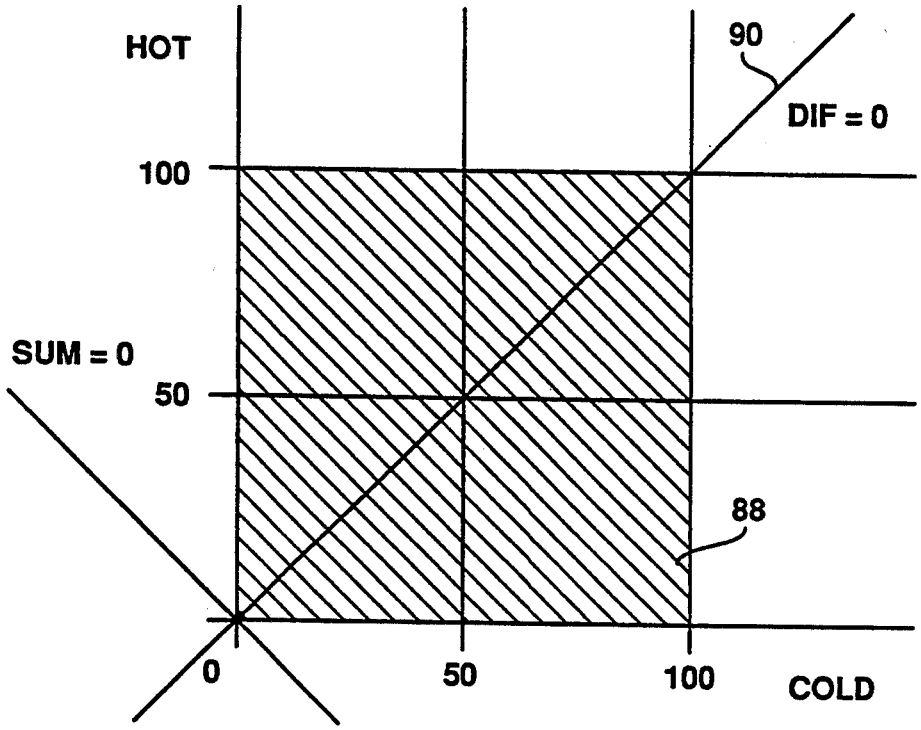
Figure 4B:
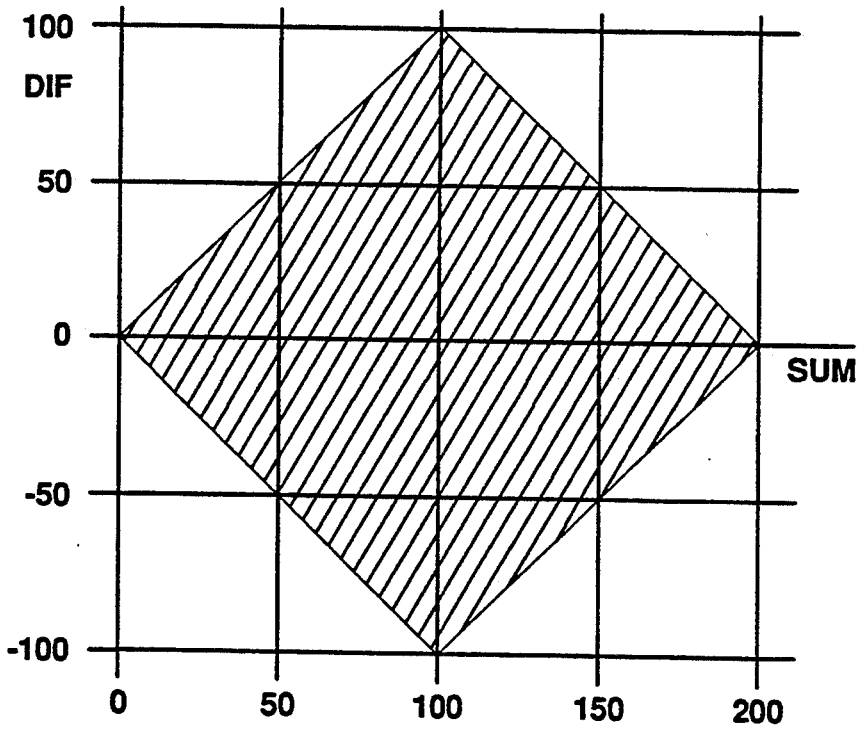
Figure 5:
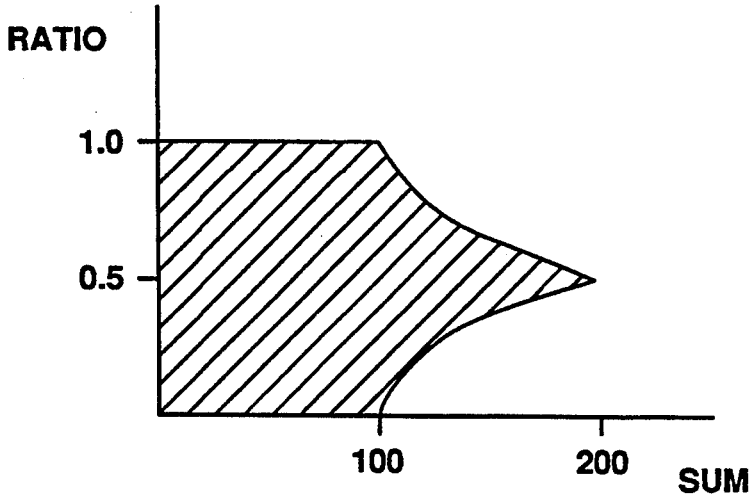

FIG. 1 illustrates a dual duct HVAC system in accordance with the invention;

FIG. 2*a* is a block diagram generally depicting one embodiment of a control system for determining cold damper and hot damper positions in accordance with the invention;

FIG. 2*b* is a block diagram generally depicting another embodiment of a control system which determines a damper position difference range for use in determining cold damper and hot damper positions in accordance with the invention;

FIG. 2*c* is a block diagram generally depicting another embodiment of a control system which determines a damper position sum range for use in determining cold damper and hot damper positions in accordance with the invention;

FIG. 3 is a flow chart generally depicting a method for controlling air flow in a dual duct system in accordance with the invention;

FIG. 4*a* and FIG. 4*b* are graphs depicting controller output ranges in terms of damper positions and in terms of a sum and difference value determination in accordance with the invention; and FIG. 5 is a graph depicting an acceptable control range for another embodiment of the invention.

DESCRIPTION OF THE PREFERRED EMBODIMENTS

The invention utilizes a controller that carries out a simple operation that determines the total open damper positions for two dampers in a dual duct system to effect a desired air flow. Using the total open damper positions as a fixed control value, the controller then determines a relative damper position difference between the two dampers that will effect both a desired temperature level while meeting the desired air flow requirement. In the preferred embodiment (FIG. 2*b*), the controller gives priority of air flow control over temperature control by determining a valid damper position difference range.

Referring to FIG. 1, a novel dual duct HVAC system 10 conditions the temperature and air flow to provide a desired comfort level in an area, such as a room within a building, through the use of a terminal box 11. Blowers (not shown) circulate temperature conditioned air to mixing area 12 through two separate supply air ducts 16 and 18. Supply air in air duct 16 is heated by a heater 20 prior to entering the mixing area 12. The heater 20 may be any suitable heating mechanism. The supply air in air duct 18 is cooled by heat exchanger 22 before entering the area 12. The heat exchanger 22 may be any suitable cooling mechanism. An outlet duct 24 from the mixing area 12 serves as an inlet duct to the room.

Supply air duct 16 includes an air flow regulating mechanism such as a valve mechanism or damper 26 controlled through damper actuator 27*a* under the control of a controller 28. Similarly, air supply duct 18 includes a damper 30 controlled through damper actuator 27*b* also under the control of the controller 28. The dampers 26 and 30 are used to vary the degree of opening in the ducts, which in turn varies air flow (the amount of hot or cold air) entering the mixing area 12.

A duct temperature sensor 32 generates a feedback air temperature signal 33 for the controller 28 indicative of the air temperature in outlet duct 24. Air flow sensor 34 generates a sensed feedback air flow signal 35 for the controller 28 indicative of the outgoing air flow from outlet air duct 24. The air temperature sensor 32 may be any suitable air temperature sensing device, such as a thermistor. The air flow sensor 34 may be any suitable air flow sensing device. The controller may be any suitable microprocessor based computer such as a Unitary Controller, manufactured by Landis & Gyr Powers, Inc., Buffalo Grove, Ill.

A set point selector 36, such as a temperature control knob and flow control knob, facilitates the selection of a desired air flow set point and temperature set point for the room. The set point selector 36 generates a temperature set point input signal 38 and an air flow set point input signal 40 for the controller 28. The controller 28 supplies damper control signals 42 and 44 to both the hot damper actuator 27*a* and the cold damper actuator 27*b*, respectively, to simultaneously effect the desired air flow and temperature for the room. It will be recognized that although description of the invention is being made with respect to a terminal box, the invention may be applied to any suitable dual duct configuration. For example, the dual ducts may directly enter the room and the outlet duct may draw air from the room. Hence the temperature and flow sensors 32 and 34 may be located in the room or any other suitable location.

FIG. 2*a* broadly depicts one embodiment of the invention and shows the controller 28 having a temperature control stage 52, a flow control stage 54 and a damper control stage 56. Each of these stages may be formed by software routines and associated data storage registers or buffers. It will also be recognized that discrete electric components may also be used.

The flow control stage 54 determines the amount of required air flow by comparing the air flow set point signal 40 to the sensed feedback air flow signal 35. The result is a damper position sum signal 60. This required air flow amount indicates the required damper position settings for both dampers in the two air ducts necessary to achieve the air flow set point. The damper position sum signal 60 corresponds to the required sum of both damper control signals 42 and 44 necessary to achieve the air flow set point. The damper position sum signal 60 therefore corresponds to desired air flow control. An increase in the damper position sum signal 60 requires an increase in air flow from the two ducts.

The temperature control stage 52 compares the temperature set point signal 38 with the sensed temperature signal 33 to determine the amount of combined damper position opening necessary to reach the set point temperature. The result is a damper position difference signal 62 that corresponds to the total relative position difference required between the two dampers to effectuate the set point temperature. Consequently the damper position difference signal 62 corresponds to desired temperature control. The output from the flow control stage 54 is the sum of the two damper control signals 42 and 44 and the output from the temperature control stage 52 is the difference between the two control signals 42 and 44 when both control parameters (air flow and temperature) can be simultaneously achieved.

The damper control stage 56 determines the damper control signals 42 and 44 based on the damper position sum signal 60, and the damper position difference signal 62. These signals may be represented as data stored in a register. The damper control signals 42 and 44 are represented in terms of a signal necessary to position a damper to a given open position. Hence a damper control signal equal to "85" corresponds to a damper position signal required to move the damper so that the damper is 85% open. A fully open damper is considered to be 100% open whereas a fully closed damper is considered to be 0% open.

The damper position sum signal 60 and damper position difference signal 62 are used by the position control stage 56, to perform the following linear transformations:

$$\text{hot}=(\text{sum}+\text{difference})/2$$

$$\text{cold}=(\text{sum}-\text{difference})/2$$

where "sum" is defined as: sum=hot+cold; and "difference" is defined as: difference=hot−cold. ¢Hot" refers to the percent open of the hot duct damper 26 and "cold" refers to the percent open of the cold duct damper 30.

For example, a damper position sum value of 75 represents that the combined damper positions for both ducts are 75% of the full open positions. Hence, damper 26 could be positioned to be open 50% and damper 30 could be positioned to be open 25%, so that the damper position sum value equals 75% open. Consequently, the damper control stage 56 sends an appropriate damper control signal 44 to the hot damper actuator 27*a l indicative of moving damper 26 to be* 50% open. Likewise, the damper control stage 56 generates a damper control signal 42 for cold damper actuator 27*b* which allows the damper 30 to be 25% open.

However, since the temperature must also be controlled, the damper position difference signal 62 and the damper position sum signal 60, both serve as inputs to the position control stage 56 to determine the control signals 40 and 42. Therefore, each of the two signals 60 and 62 are used to generate two suitable control signals 40 and 42 so that each of the signals 60 and 62 influence both of the dampers. To illustrate, TABLE 1 shows various damper control signal valves for signals 40 and 42 generated by the controller as derived from the damper position sum signal 60 and difference signal 62 using the above mentioned linear transformations.

TABLE 1

| CASE | SUM VALUE | DIFFERENCE VALUE | HOT | COLD |
|---|---|---|---|---|
| 1 | 0 | 0 | 0 | 0 |
| 2 | 100 | 0 | 50 | 50 |
| 3 | 200 | 0 | 100 | 100 |
| 4 | 100 | 100 | 100 | 0 |
| 5 | 100 | −100 | 0 | 100 |
| 6 | 100 | 50 | 75 | 25 |
| 7 | 30 | −10 | 10 | 20 |
| 8 | 150 | −10 | 70 | 80 |
| 9 | 50 | 50 | 50 | 0 |
| 10 | 50 | 60 | X | X |
| 11 | 150 | 50 | 100 | 50 |
| 12 | 150 | 60 | X | X |

As shown in Table 1, the control signals are determined based on a damper position sum value and a damper difference value. These values are numerical representations of the damper position sum signal 60 and the damper position difference signal 62, respectively. When the difference value is zero, indicating that the damper positions are the same, the hot and cold damper position signal values (corresponding to the position signal as 42 and 44) are both the same and the sum can be between 0 and 200 (Cases 1, 2, 3). When the difference value between damper positions is positive, the hot damper is open more than the cold damper (Case 4). When the difference in damper positions is negative, the cold damper should be open more than the hot damper (Case 5). When the sum is 100, the difference between damper positions can be between −100 and +100 (Cases 2, 4, 5).

As indicated, there are other combinations of the sum and difference damper positions that are impossible because of limits on the hot and cold dampers (Cases 10 and 12). To adjust to such conditions, the damper position sum signal 60 may serve as a priority air flow control value. The controller 28, through the damper control stage 56, enforces a priority of the damper position sum signal 60 over the damper position difference signal 62 when the combination would produce invalid damper control signals 42 and 44. The controller 28 applies absolute priority to the sum signal 60 over the difference signal 62 so that air flow is given priority over temperature control.

For example, in Case 10 (TABLE 1) where the sum value of the dampers is 50, but the temperature control stage determines that the desired air temperature (set point temperature) requires a damper difference value of 60, indicating that additional hot air flow is required, the hot damper value (damper control signal 44) may be 50 and the cold damper value (damper control signal 42) may be 0 so that the allowable maximum difference value is 50 (sum). Therefore the air flow will be controlled properly at the expense of the temperature. Accordingly, the control system utilizes simple transformations to electrically control both dampers to provide the required air flow to the area.

As described, the damper sum signal 60 and the damper difference signal 62 serve as control information for generating both interdependent damper control signals 42 and 44 so that the system 10 controls (moves) both dampers each time flow control or temperature control is necessary. Each signal 60 and 62 influence the control of both dampers. Accordingly, the aforedescribed simple control system provides a unique de-coupling of flow control and temperature control because the sum signal 60 has a strong effect on flow control and a more negligible effect on temperature control. For example, when no temperature change is necessary, both dampers will open the same amount to effectuate the proper air flow because the controller 28 electrically controls the damper actuators 27*a* and 27*b* to move both dampers (two control signals 42 and 44 are generated). Unlike conventional dual-duct control systems, both dampers are electrically controlled to move to facilitate a change for either air temperature or air flow. Each signal 60 and 62 has some control over both dampers. However, when a conflict between control parameters arises, one parameter is given priority over the other. The controller moves the dampers in the same direction to control air flow and moves the dampers in an opposite direction to control temperature.

FIG. 2*b* shows the controller 28 adapted for giving absolute priority of flow control (the sum signal 60) over temperature control (the difference signal 62) through the use of a damper position range generating stage 64. The damper position sum signal 60 serves as an input signal for the damper position range stage 64 and the damper position control stage 56.

The position range stage 64 and damper position control stage 56 dynamically determine an acceptable damper position difference range 66. An acceptable range includes the range of damper positions wherein the sum value is actually met and difference value will not cause either of the dampers to exceed their stroke. The temperature control stage 52 use the difference range 66 to select appropriate damper difference signals 62 which will facilitate reaching or approaching the set point temperature value 38.

The damper position range generating stage 64 determines the damper position control signal difference range 66 based on the damper sum value and determines the minimum and maximum difference signal values. The damper control stage 56 gives priority to the damper sum value so that air flow takes priority over temperature control when one of the dampers is at the end of its stroke or otherwise prevented from moving to a suitable position, e.g., when movement of one of the dampers causes the control signal to fall outside the difference range. Priority for flow control when the dampers are at such physical limits is accomplished by dynamically and continuously determining the limits of the damper difference signal 66 so that the temperature control stage 52 continuously generates the acceptable damper position difference signal 62. It will be recognized that other mechanisms may be used to determine whether a damper is at an end of its stroke. For example, a position sensor may be affixed to the damper and send a signal when the damper is completely open or completely closed.

The controller 28 is calibrated so that a 0 position value corresponds to one end of the damper's stroke (i.e., fully closed damper) and 100 position value corresponds to the other end of the damper's stroke (i.e., fully open). The damper position difference range 66 is determined by the position range stage based on the following linear transformations:

(a.) allowable maximum difference value=smaller of (sum or (200−sum)); and (b.) allowable minimum difference value=−(allowable maximum difference value).

The position difference range 66 is based on the sum signal so that air flow control is given priority over temperature control. The position range stage 64 determines whether either of the dampers is at an end of it's stroke when the damper difference signal reaches the allowable maximum difference or allowable minimal difference. The acceptable position difference range 66 provides the temperature control stage 52 with a proper range of damper difference position settings so that air flow control is given priority.

Alternatively, FIG. 2*c* shows the controller 28 adapted to give priority of temperature control over air flow control. Analogous to the sum signal 60 of FIG. 2*b*, the damper position difference signal 62 serves as an input variable to the damper position range stage 64 and the damper position control stage 56 so that the controller can dynamically determine an acceptable damper position sum value range 68. An acceptable range includes the range of damper position values wherein the difference value is actually met and the sum value will not cause either of the dampers to exceed their stroke.

FIG. 3 shows the method for controlling the comfort level in the area using the system shown in FIGS. 1 and 2*a*–2*c*. The method starts at block 70. A temperature set point is selected as shown in block 72 representing the desired temperature in the room or mixing area 12. This may be accomplished by programming the set point into the memory of the controller or adjusting a temperature set dial such as that found on a thermostat control panel, or any other mechanism for adjusting the set point.

As shown in block 74, the desired air flow set point is selected in a similar manner as the temperature select point. Based on the feedback air flow signal 35 and the selected air flow set point, the controller 28 generates the damper position sum signal 60 indicating the required damper openings from both dampers to achieve the air flow set point as shown in block 76.

The controller then determines the relative hot and cold damper difference range 66, based on the damper position sum signal 60 and the known damper position as previously described, as shown in block 78. In block 80, the controller determines the damper position difference signal based on the damper position range 66, the feedback temperature 33 and the set point temperature 38 as previously described.

Suitable damper position control signals 42 and 44 are generated based on the damper difference signal 62 and sum signal 60, as indicated in block 82. The controller 28 electrically controls both dampers in response to each of the air flow adjustment signal and the air temperature adjustment signal in an effort to effect both the selected air flow set point and said selected temperature set point. Hence, the controller outputs suitable damper position control signals 42 and 44 to the damper actuators 27*a* and 27*b* as shown in block 84.

Where the controller is unable to effect both the set amount of air flow and the set temperature due to one or both of the dampers being at an end of its stroke, the controller will give priority to one of the parameters, such as air flow control. The manufacturer may set the priority control parameter. The controller determines whether either of the dampers is at an end of its stroke and moves the dampers to achieve the set air flow such that the dampers are electrically controlled to effect the air flow set point at the expense of attaining the temperature set point. The process ends as shown in block 86 and the controller continues to repeat the method on a continuous basis to ensure a continuous proper level of air flow and temperature control of the area.

FIG. 4*a* represents the controller output to the damper actuators in terms of hot damper and cold damper position values. The gray area 88 is the valid range of damper control signals 42 and 44. The range is limited by the stroke of each damper. As shown by line 90, when the position difference range is zero, an equal damper position is arranged for each duct. The X-axis shows the percentage of the cold damper position from 0% open to a 100% open, whereas the Y-axis indicates the hot damper open position from 0% open to 100% open.

FIG. 4*b* illustrates the controller output control signals to the damper actuators in terms of the sum and difference values between damper positions. The X-axis represents the sum range of both dampers being from 0% to 200% wherein each damper may be open 100%. The Y-axis represents the difference value between damper positions having the range of −100 to +100. The shaded area 88 indicates the acceptable operating range for suitable controller outputs for the system.

An alternative method may use the sum value as previously described and a ratio of the hot damper position to the sum value so that flow control is still prioritized over temperature control. Referring back to TABLE 1 (cases 7 and 8), when the sum value changes from 30 to 150 at constant difference, a mix of hot and cold air can be expected to get much more neutral. The ratio of the hot damper to the sum facilitates a similar function as the difference in the previously described embodiment. Hence, the system may keep a constant ratio between hot and sum so that the 150 sum would be reached by combining 50 hot with 100 cold. This also isolates the temperature control from the flow control. FIG. 5 illustrates the controller output in terms of the sum and ratio embodiment just described.

Another modification to the aforedescribed sum/difference methodology may be used where different sized ducts are used or different types of dampers are used. It may be beneficial to weight one of the damper position settings with a weighing factor to compensate for a difference in duct size or air flow volume rate. For example, where a hot duct has a larger cross section than the cold air duct, the flow rates may be different. Consequently, a hot damper position or the cold damper position may be weighted accordingly, to compensate for the change in duct air flow rate. The following equations may be used to determine the sum and difference with a weighing factor which may then be incorporated in the system described with reference to FIGS. 1–3:

sum=hot+weighing factor*cold difference=hot−weighing factor,cold.

The inventive system eliminates the need for complex mechanical linkages between dampers and offers the ability to give absolute priority of one control parameter over another. The system generates an electric control signal for both dampers in response to each of the air flow adjustment signal and the air temperature adjustment signal. Both dampers are moved to control temperature and both dampers are moved to control air flow.

Specific embodiments of a novel system and method for a dual duct system have been described for the purposes of illustrating the manner in which the invention may be used and made. It should be understood that the implementation of other variations and modifications of the invention, in its various aspects, will be apparent to those of ordinary skill in the art, and that the invention is not limited by the specific embodiments described herein. Various features of the present invention are set forth in the following claims.

What is claimed is:

1. A method for controlling air flow in a dual-duct HVAC system to provide a desired temperature and air flow in an area, each of the ducts having a damper means therein for regulating air flow therethrough, each damper means being adapted to be positioned from one end to the other end of its stroke and thereby regulate air flow in the duct, the method comprising:

selecting a desired temperature set point for the area;

selecting a desired air flow set point for the area;

generating a temperature signal representing a measured temperature in the area;

generating an air flow signal representing a measured amount of air flow in the area;

generating an air flow adjustment signal based upon said air flow set point and sad air flow signal;

generating a temperature adjustment signal based upon said temperature set point and said temperature signal;

determining whether either of the damper means is at an end of its stroke;

controlling both dampers in response to each of said air flow adjustment signal and said air temperature adjustment signal to at least approach both said selected air flow set point and said selected temperature set point; and prioritizing air flow control over temperature control when at least one of the damper means has reached an end of tis stroke such that the damper means are controlled to effect the air flow set point at the expense of attaining the temperature set point.

2. A method for controlling air flow in a dual-duct HVAC system to provide a desired temperature and air flow in an area, each of the ducts having a damper means therein for regulating air flow therethrough, each damper means being adapted to be positioned from one end to the other end of its stroke and thereby regulate air flow in the duct, the method comprising:

selecting a desired temperature set point for the area;

selecting a desired air flow set point for the area;

generating a temperature signal representing a measured temperature in the area;

generating an air flow signal representing a measured amount of air flow in the area;

generating an air flow adjustment signal based upon said air flow set point and said air flow signal wherein said air flow adjustment signal represents a total amount of damper means opening position required for the combination of both damper means to effectuate the desired air flow;

generating a temperature adjustment signal based upon said temperature set point and said temperature signal wherein said temperature adjustment signal represents a difference in damper position between the damper means necessary to effect said temperature set point;

determining whether either of the damper means is at an end of its stroke;

controlling both damper means in response to each of said air flow adjustment signal and said air temperature adjustment signal to at least approach both said selected air flow set point and said selected temperature set point; and prioritizing air flow control over temperature control when at least one of the damper means has reached an end of its stroke such that the damper means are controlled to effect the air flow set point at the expense of attaining the temperature set point.

3. The method of claim 2 wherein controlling both damper means includes the step of:

generating an electric damper means position control signal for concurrently controlling both damper means based upon each of said air flow adjustment signal and said air temperature adjustment signal.

4. A system for controlling air flow in a dual-duct HVAC system to provide a desired temperature and air flow in an area, each of the duct having a damper means therein for regulating air flow therethrough, each damper means being adapted to be positioned from one end to the other end of its stroke and thereby regulate air flow in the duct, the system comprising:

means for selecting a desired temperature set point for the area;

means for selecting a desired air flow set point for the area;

means for generating a temperature signal representing a measured temperature in the area;

means for generating an air flow signal representing a measured amount of air flow in the area;

means for generating an air flow adjustment signal based upon said air flow set point and said air flow signal wherein said air flow adjustment signal represents a total amount of damper means opening position required for the combination of both damper means to effectuate the desired air flow;

means for generating a temperature adjustment signal based upon said temperature set point and said temperature signal wherein said temperature adjustment signal represents a difference in damper means potion between the damper means necessary to effect said temperature set point;

means for dynamically determining a damper means position difference range, based on said air flow adjustment signal to produce an allowable maximum difference value and an allowable minimum value, wherein said damper means position difference range represents a range of allowable relative damper means position settings that are adapted to produce a selected desired air flow;

means for generating damper means position control signals, that fall within said damper means position difference range, for each of the damper means; and means for controlling both damper means in response to each of said air flow adjustment signal and said air temperature adjustment signal to at least approach both said selected air flow set point and said selected temperature set point.

5. A system for controlling air flow in a dual-duct HVAC system to provide a desired temperature and air flow in an area, each of the duct having a damper means therein for regulating air flow therethrough, each damper means being adapted to be positioned from one end to the other end of its stroke and thereby regulate air flow in the duct, the system comprising:

selecting a desired temperature set point for the area;

selecting a desired air flow set point for the area;

generating a temperature signal representing a measured temperature in the area;

generating an air flow signal representing a measured amount o fair flow in the area;

generating an air flow adjustment signal based upon said air flow set point and said air flow signal;

generating a temperature adjustment signal based upon said temperature set point and said temperature signal;

determining whether either of the damper means is at an end of its stroke;

controlling both dampers in response to each of said air flow adjustment signal and said air temperature adjustment signal to at least approach both said selected air flow set point and said selected temperature set point; and prioritizing temperature control over air flow control when at least one of the damper means has reached an end of tis stroke such that the damper means are controlled to effect the temperature set point at the expense of attaining the air flow set point.

6. A method for controlling air flow in a dual-duct HVAC system to provide a desired temperature and air flow in an area, each of the ducts having a damper means therein for regulating air flow therethrough, each damper means being adapted to be positioned form one end to the other end of its stroke and thereby regulate air flow in the duct, the method comprising:

selecting a desired temperature set point for the area;

selecting a desired air flow set point for the area;

generating a temperature signal representing a measured temperature in the area;

generating an air flow signal representing a measured amount o fair flow in the area;

generating an air flow adjustment signal based upon said air flow set point and said air flow signal wherein said air flow adjustment signal represents a total amount of damper means opening position required for the combination of both damper means to effectuate the desired air flow;

generating a temperature adjustment signal based upon said temperature set point and said temperature signal wherein said temperature adjustment signal represents a difference in damper position between the damper means necessary to effect said temperature set point;

determining whether either of the damper means is at an end of its stroke;

controlling both dampers in response to each of said air flow adjustment signal and said air temperature adjustment signal to at least approach both said selected air flow set point and said selected temperature set point; and prioritizing temperature control over air flow control when at least one of the damper means has reached an end of tis stroke such that the damper means are controlled to effect the temperature set point at the expense of attaining the air flow set point.

7. A method for controlling air flow in a dual-duct HVAC system to provide a desired temperature and air flow in an area, each of the ducts having a damper means therein for regulating air flow therethrough, each damper means being adapted to be positioned form one end to the other end of its stroke and thereby regulate air flow in the duct, the method comprising:

selecting a desired temperature set point for the area;

selecting a desired air flow set point for the area;

generating a temperature signal representing a measured temperature in the area;

generating an air flow signal representing a measured amount o fair flow in the area;

generating an air flow adjustment signal based upon said air flow set point and said air flow signal wherein said air flow adjustment signal represents a total amount of damper means opening position required for the combination of both damper means to effectuate the desired air flow;

generating a temperature adjustment signal based upon said temperature set point and said temperature signal wherein said temperature adjustment signal represents a difference in damper position between the damper means necessary to effect said temperature set point;

controlling both damper means in response to each of said air flow adjustment signal and said air temperature adjustment signal to at least approach both said selected air flow set point and said selected temperature set point;

dynamically determining a position difference range, based on said air flow adjustment signal to produce an allowable maximum difference value and an allowable minimum difference value, wherein said damper means position difference range represents a range of allowable relative damper means position settings that effectuate a desired air flow; and generating damper means position control signals, that fall within said damper means position difference range, for each of the damper means.

8. A system for controlling air flow in a dual-duct HVAC system to provide a desired temperature and air flow in an area, each of the duct having a damper means therein for regulating air flow therethrough, each damper means being adapted to be positioned from one end to the other end of its stroke and thereby regulate air flow in the duct, the system comprising:

means for selecting a desired temperature set point for the area;

means for selecting a desired air flow set point for the area;

means for generating a temperature signal representing a measured temperature in the area;

means for generating an air flow signal representing a measured amount of air flow in the area;

means for generating an air flow adjustment signal based upon said air flow set point and said air flow signal wherein said air flow adjustment signal represents a total amount of damper means opening position required for the combination of both damper means to effectuate the desired air flow;

means for generating a temperature adjustment signal based upon said temperature set point and said temperature signal wherein said temperature adjustment signal represents a difference in damper means potion between the damper means necessary to effect said temperature set point;

means for determining whether either of the damper means is at an end of its stroke;

means for prioritizing control of one of the parameters of air flow and temperature when at least one of the damper means has reached an end of its stroke; and means for controlling both damper means in response to each of said air flow adjustment signal and said air temperature adjustment signal to at least approach both said selected air flow set point and said selected temperature set point.

* * * * *

UNITED STATES PATENT AND TRADEMARK OFFICE

CERTIFICATE OF CORRECTION

PATENT NO. : 5,350,113

DATED : September 27, 1994

INVENTOR(S) : James J. Coogan

It is certified that error appears in the above-indentified patent and that said Letters Patent is hereby corrected as shown below:

In column 5, line 57, delete "¢" and insert --"--.

In column 5, line 68, after 27a delete "l".

In column 5-6, line 68 & 1, remove italics.

In column 6, line 41, delete "signal" and insert --signals--.

In column 10, line 36, delete "sad" and insert --said--.

In column 10, line 49, delete "tis" and insert --its--.

In column 11, line 29, delete "duct" and insert --ducts--.

In column 11, line 52, delete "potion" and insert --position--.

In column 12, line 3, delete "system" and insert --method--.

In column 12, line 5, delete "duct and insert --ducts--.

In column 12, line 9, delete "system" and insert --method--.

In column 12, line 15, delete "o fair" and insert --of air--.

In column 12, line 31, delete "tis" and insert --its--.

UNITED STATES PATENT AND TRADEMARK OFFICE

CERTIFICATE OF CORRECTION

PATENT NO. : 5,350,113

DATED : September 27, 1994

INVENTOR(S) : James J. Coogan

It is certified that error appears in the above-indentified patent and that said Letters Patent is hereby corrected as shown below:

In column 12, line 38, delete "form" and insert --from--.

In column 12, line 46, delete "o fair" and insert --of air--.

In column 12, line 61, delete "dampers" and insert --damper means--.

In column 12, line 68, delete "tis" and insert --its--.

In column 13, line 8, delete "form" and insert --from--.

In column 13, line 16, delete "o fair" and insert --of air--.

In column 14, line 6, delete "duct" and insert --ducts--.

In column 14, line 29, delete "potion" and insert --position--.

Signed and Sealed this

Twenty-eight Day of March, 1995

Bruce Lehman

*Attest:*

BRUCE LEHMAN

*Attesting Officer*

*Commissioner of Patents and Trademarks*